US008257050B2

(12) United States Patent
Timoshkin et al.

(10) Patent No.: US 8,257,050 B2
(45) Date of Patent: Sep. 4, 2012

(54) APPARATUS AND METHOD FOR ELECTRIC SPARK PEENING OF GAS TURBINE COMPONENTS

(75) Inventors: Igor Timoshkin, Glasgow (GB); Scott J. MacGregor, Cambuslamg (GB)

(73) Assignee: Rolls-Royce PLC, London (GB)

( * ) Notice: Subject to any disclaimer, the term of this patent is extended or adjusted under 35 U.S.C. 154(b) by 564 days.

(21) Appl. No.: 12/310,565

(22) PCT Filed: Aug. 30, 2007

(86) PCT No.: PCT/GB2007/003275

§ 371 (c)(1), (2), (4) Date: Mar. 11, 2009

(87) PCT Pub. No.: WO2008/037949

PCT Pub. Date: Apr. 4, 2008

(65) Prior Publication Data

US 2010/0008786 A1 Jan. 14, 2010

(30) Foreign Application Priority Data

Sep. 27, 2006 (GB) ..... 0618977.3

(51) Int. Cl.
*B63H 1/26* (2006.01)
*B63H 7/02* (2006.01)

(52) U.S. Cl. ..... 416/241 R; 29/421.1; 29/421.2; 72/56

(58) Field of Classification Search ..... 29/421.1, 29/421.2; 72/56
See application file for complete search history.

(56) References Cited

U.S. PATENT DOCUMENTS

| | | | | |
|---|---|---|---|---|
| 3,228,221 | A * | 1/1966 | Zernow et al. | 72/56 |
| 3,852,985 | A | 12/1974 | Haeusler et al. | |
| 6,664,506 | B2 | 12/2003 | Clauer et al. | |
| 2002/0037218 | A1 * | 3/2002 | Webster | 415/191 |

FOREIGN PATENT DOCUMENTS

| | | | |
|---|---|---|---|
| EP | 1 191 112 | A1 | 3/2002 |
| GB | 1129562 | | 10/1968 |
| GB | 1129562 | A * | 10/1968 |

* cited by examiner

*Primary Examiner* — Ha Tran T Nguyen
*Assistant Examiner* — Aaron Dehne
(74) *Attorney, Agent, or Firm* — Oliff & Berridge, PLC

(57) ABSTRACT

Peening provides compression of component surfaces in order to create residual surface compressions to resist crack propagation in components such as aerofoils. Previously peening techniques have had problems with respect to achieving adequate treatment depths, speed of treatment and with respect to effectiveness. By the present method arrangement an electrical conductor in the form of a wire is subject to electrical pulses to cause evaporation and subsequent breakdown with high power ultrasound (HPU) propagation in a volume of dielectric fluid towards a component and so peening. The electrical conductor ensures that there is limited possibility of electrical discharge to the component surface while the positioning of the wire relative to the surface can be adjusted to achieve best effect particularly if reflector devices are utilized to concentrate (HPU) pulse presentation to the component. Furthermore, the component can be surface treated in order to provide protection from potentially damaging emissions from evaporation and electrical discharge to the wire.

25 Claims, 3 Drawing Sheets

APPARATUS AND METHOD FOR ELECTRIC SPARK PEENING OF GAS TURBINE COMPONENTS

The present invention relates to peening and more particularly to electric spark peening in order to provide surface residual stressing for toughening components such as aerofoils in a gas turbine engine.

Traditionally peening has been provided by firing shot at a surface in order to create surface residual stressing which is compressive in order to inhibit crack propagation and failure in components.

It is known that beneficial compressive residual stresses may be introduced into a surface layer of a metal workpiece by means of mechanical peening. These methods of mechanical treatment of metal workpieces use spherical shots and microbeads. Each piece of the shot acts as a localised peening impactor to produce elastic stretching of the surface layers along with local plastic deformation that manifests itself as a residual compressive stress.

Other methods of the development of compressive residual stresses rely upon the shock wave treatment of the workpiece. There is a laser shock peening method described by A. Clauer et al, in U.S. Pat. No. 6,664,506 Dec. 16, 2003. In a laser shock peening method, a high power laser pulse is focussed on the metal surface which is pre-covered with a thin layer of sacrificial ablative material. This material is subsequently vaporised, the resulting expanding cavity filled with hot gases (plasma) induces a stress wave that travels through the bulk of the workpiece. In a plasma discharge method an expanding plasma cavity is developed by a free spark discharged in a liquid medium above the workpiece surface. The expanding cavity generates an acoustic high pressure pulse which impacts upon the surface of the metal component to be peened.

Each of these known processes has limitations. Thus mechanical peening only achieves localised compressive residual stressing to a relatively small depth and leaves a roughened surface which in itself can develop fatigue cracks. Laser shot peening only allows a small area of treatment upon each single laser pulse and generally lower peening pressures are developed than with mechanical shot peening leading to longer treatment times. Plasma discharge peening requires long distances between the source of shock waves and the surface to be treated which can attenuate the magnitude of the peening shockwave and also there are limitations with respect to low incident discharge energy.

In accordance with the present invention there is provided a peening arrangement for a component, the arrangement comprising an electrical conductor, a volume of dielectric liquid and means to provide an electrical pulse to cause vaporisation of the electrical conductor, the arrangement is provided with means for presentation of a component in use in the volume of dielectric liquid adjacent to the electrical wire to receive shock waves caused by vaporisation of the electrical wire due to the electrical pulse.

Normally, the electrical conductor is a wire formed from an appropriate metal.

Typically, a reflector is positioned to reflect shock waves towards a component in use.

Typically, an electrical conductor feeder is provided in the arrangement. Generally, the feeder comprises a feeder electrode to push the electrical conductor towards a contact electrode to provide a pulse when contact is made between the electrical conductor and the contact electrode.

Possibly, the arrangement incorporates a number of electrical conductors to provide respective shock waves. Alternatively, the conductor feeder comprises a carousel of single electrical conductors extending between electrodes with the carousel adjusting after each evaporation of the electric conductor to present a new electric conductor adjacent a component in use.

Generally, an electrical conductor is provided to one side of a component in use. Alternatively, an electrical conductor substantially surrounds a component in use. Further alternatively, an electrical conductor enters a cavity or hole in the component in use.

Typically, the means to provide the electrical pulse is adjustable to vary the strength of the shock wave.

Possibly, the arrangement incorporates means to equalise the shock wave along the length of the electrical conductor upon presentation to a component in use. Potentially, the arrangement incorporates means to provide a protective coating to a component to protect the component from vaporisation products produced by an electrical discharge. Typically the protective coating is removable.

Also in accordance with the present invention there is provided a method of peening a component, the method comprising presenting a component and an electrical conductor adjacent to one another within a volume of dielectric liquid, presenting an electrical pulse in the electrical conductor sufficient to cause evaporation of the electrical conductor and subsequent electrical breakdown of the resultant vapour to provide a pressure pulse to impact as a shock wave upon the component.

Advantageously the method includes providing a protective coating to the component. Further advantageously, the method and the apparatus incorporates means for adjusting the length of the electrical conductor to vary the vaporisation of the conductor.

Additionally, in accordance with the present invention there is provided a method of peening a component using a peening arrangement as described above.

Embodiments of the present invention will now be described by way of example and with reference to the accompanying drawings in which.

Figure 1:
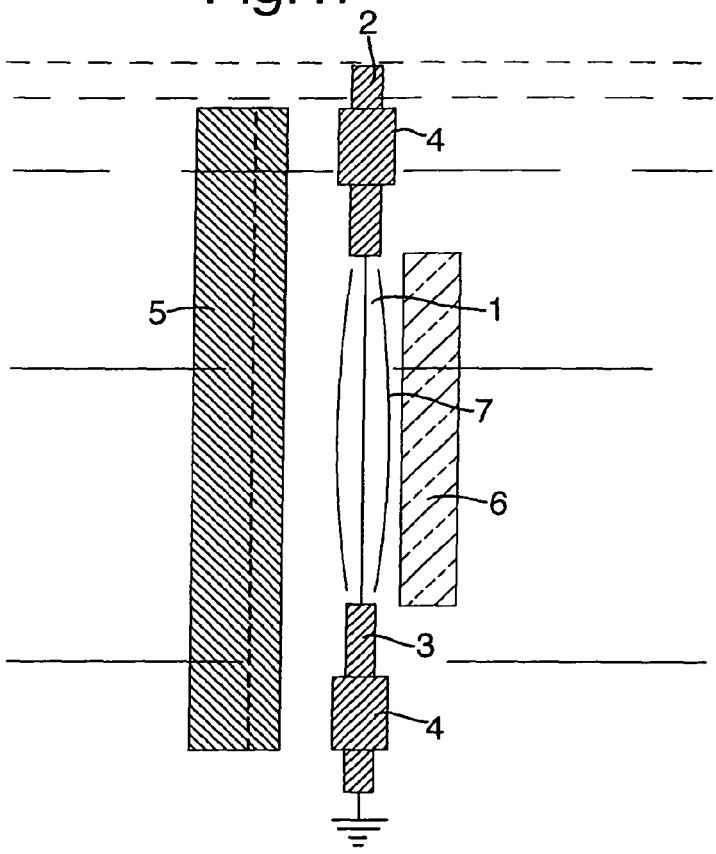
FIG. 1 is a schematic illustration of a first embodiment of a peening arrangement in accordance with the present invention.

The present arrangement provides an electrical conductor or wire guided shock peening method involving generation of intense high power ultrasound (HPU) pulses in a liquid medium by fast impulse Joule heating of a thin conductive wire. The apparatus required for wire guided shock peening implementation includes an electrical pulsed power system, a HPU acoustic source with an electrode assembly, a work piece holder and a vessel filled with a dielectric liquid. An impulse current generated by the pulse power system passes through a thin electrically conducting wire immersed in the liquid. The wire plays the role of the initial plasma streamer that completes the electrical circuit. Rapid vaporisation of the metal wire is followed by electrical breakdown of the resulting metal vapour and the subsequent development of the high pressure plasma breakdown channel that expands with a velocity of 100 to 1000 m/s (in water). Such fast expansion produces a shock wave which streams from the channel quickly transferring into a high-power ultrasound pulse that radiates from the plasma discharge. This HPU pulse, with a pressure amplitude of hundreds of MPa, travels a short distance in the liquid and impacts upon the materials being processed and thereby generates residual stresses through surface layer compression. As shown in FIG. 1 a reflector is used to concentrate the acoustic energy on the target surface may be positioned in such a way that the conducting wire is located between the reflector and the workpiece.

FIG. 1 shows a first embodiment of an arrangement in accordance with the present invention in which an electrical wire 1 extends from a high voltage electrode 2 to a ground electrode 3. The electrodes are respectively presented through electrical insulators 4 and the wire 1 is located in a volume of dielectric liquid such as water or oil between a reflector 5 and a component or workpiece 6. In such circumstances when a sufficiently high electrical current is passed through the wire 1 there is vaporisation of the wire and subsequent electrical breakdown of the vaporisation products causes a shock wave in the form of a high power ultrasound pulse (HPU) 7 which emanates from the wire 1. This HPU pulse is reflected by the reflector 5 to further impinge upon the component 6 to cause peening.

Figure 2:
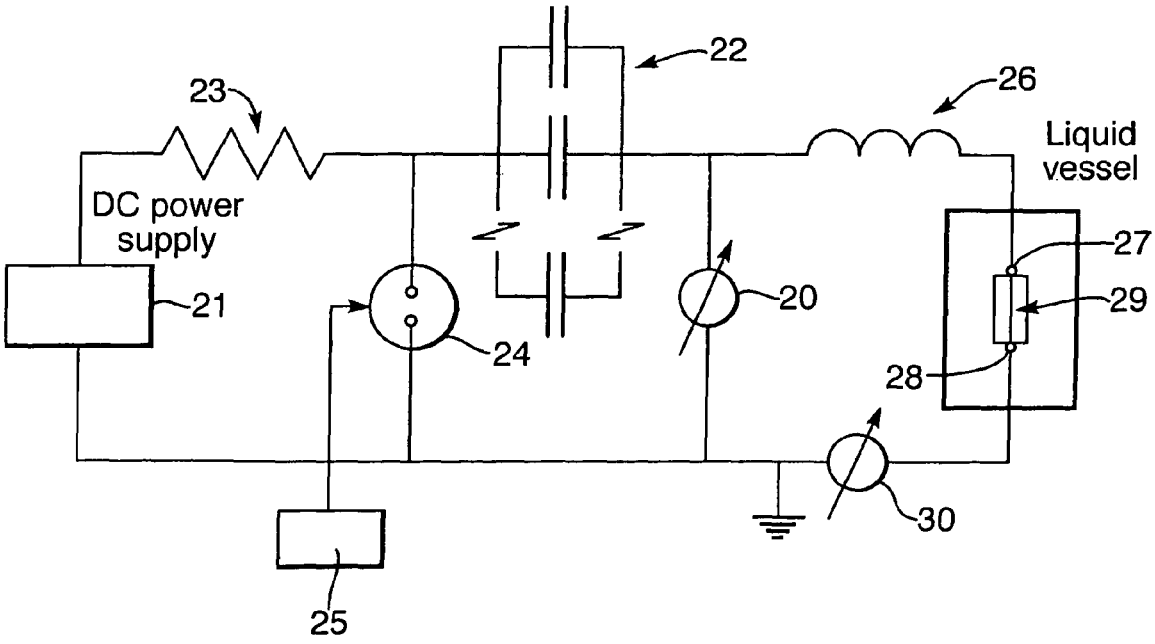
FIG. 2 is a circuit diagram illustrating a peening arrangement in accordance with the present invention.

As shown in FIG. 2, the present arrangement has an electrical pulsed power system comprising a DC high voltage source 21 which charges an energy storage device, such as a high voltage capacitor bank 22 at a voltage level up to 50 kV through a charging resistor 23, a closing gas-filled switch 24 with a trigger 25 and a transmission coaxial cable 26. When the capacitors 22 are fully charged, the trigger 25 sends a triggering electrical pulse and the switch 24 is closed. After switch 24 closure, electrical energy accumulated into the energy storage devices 22 transfers to electrodes 27, 28 of the HPU source via the coaxial high voltage cable 26. The high voltage appears at the ends of a conductive electrical wire 29 and a high electrical current (with a peak value up to 20 kA) starts to flow through the wire 29. The electrical energy accumulated in the capacitor bank 22 of the pulsed power system starts to dissipate first in the wire and then in the plasma channel developed through fast Joule heating and evaporation of the wire 29 with the current and voltage wave forms determined by the electrical parameters of the pulsed power circuit (capacitance, inductance and resistance) and the physical parameters of the wire (length, cross-section, conductance). The electrical current and voltage wave forms may be monitored by high speed high voltage and current probes 20, 30. Preferably the current pulse created by the pulsed power supply has a duration in the range 1-300 microseconds with a current rise time of less than 1 microsecond.

Figure 3:
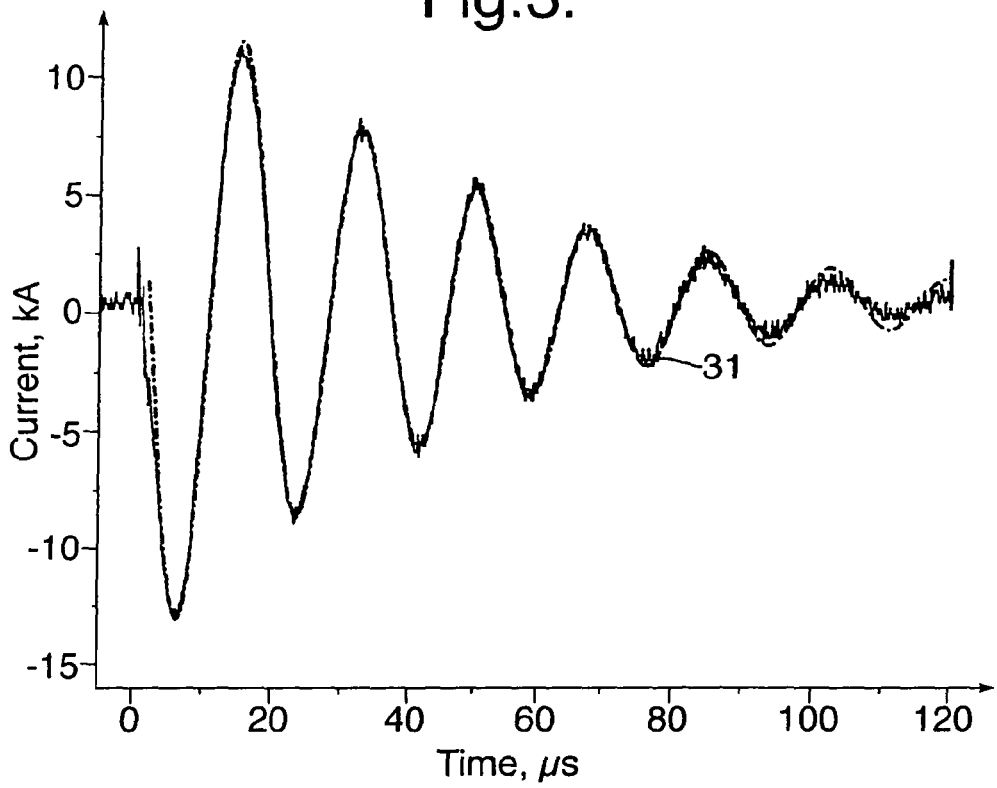
FIG. 3 is a graphical illustration of a current wave formed during peening.

FIG. 3 illustrates a typical electrical current wave form 31 during wire guided electrical shock peening. The length of the wire in this example was 35 mm, the applied voltage was 30 kV, the energy available in the pulse was 756 J. The current pulse has a damped oscillatory wave formed with a peak current of 12.5 kA.

The HPU acoustic source may comprise a wire holder with a mechanism to change wires after each current pulse and a cylindrical, parabolic or ellipsoidal reflector to concentrate the acoustic energy on the metal surface or a restraining member to reflect the acoustic energy towards the metal surface.

An apparatus to change wires may comprise a feeder which pushes the wire through an inter-electrode gap between a feeder electrode and a contact electrode. As soon as the wire touches an opposite contact electrode, the pulsed electrical circuit becomes closed and the fast current pulse starts to travel through the wire resulting in development of the expanding plasma channel.

The HPU source may be altered in that several wires may be heated simultaneously with a single current pulse. Several parallel conducting wires will rover several plasma channels which may increase the efficiency of the electrical energy conservation and may increase the area of the workpiece subjected to the wire guide shock peening treatment.

The surface of the workpiece to be treated may be covered with a protective coating (which could consist of a thin layer of a metal film) to protect the surface from any possible damage due to close location of the plasma channel, that is to say evaporation products from the wire. The protective sacrificial layer could be removed after the wire guided electrical shock penning process. Application of the protective layers allows the conductive wire to be located as close to the surface of the workpiece as possible without causing damage by hot gases or secondary discharges to the metallic surface.

Figure 4:
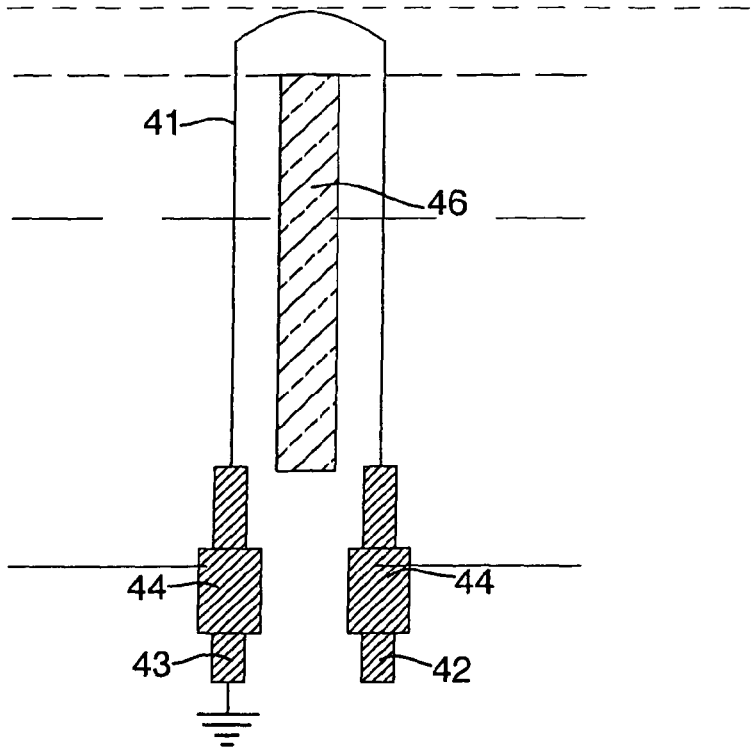
FIG. 4 is a schematic illustration of a second embodiment of a peening arrangement in accordance with the present invention; and, FIG. 5 illustrates a third embodiment of a peening arrangement in accordance with the present invention.

Referring to FIG. 4 there is an embodiment of the invention which includes location of the conducting wire in such a way that a single current pulse will perform shock peening of both sides of the workpiece at the same time. This modification of the wire geometry allows deformation of the thin metal workpieces (such as aerofoil sections of a compressor or turbine blade) to be avoided.

FIG. 4 schematically illustrates alternative embodiments of a peening arrangement in accordance with the present invention in which a workpiece or component 46 is substantially subjected to peening treatment about substantially all of its surface. Thus, a high voltage electrode 42 is coupled to an electrical wire 41 which extends substantially around the component 46 in a volume of dielectric liquid. The thin electrical wire 41 extends to a ground electrode 43 in order to make an electrical circuit. The electrodes 42, 43 are respectively protected by insulators 44. In such circumstances, as described previously, an electrical pulse is passed along the wire 41 in order to cause vaporisation which in turn through breakdown of the vaporisation products causes a high pressure ultra sonic wave or pressure pulse which impinges upon the component 46 in order to cause peening treatment. As the wire 42 substantially extends around the bulk of the component 46 surface it will be appreciated that these peening pressure pulses impinge upon the surfaces opposed by the wire 41 and therefore most of the component 46 will be subject to peening treatment.

Figure 5:
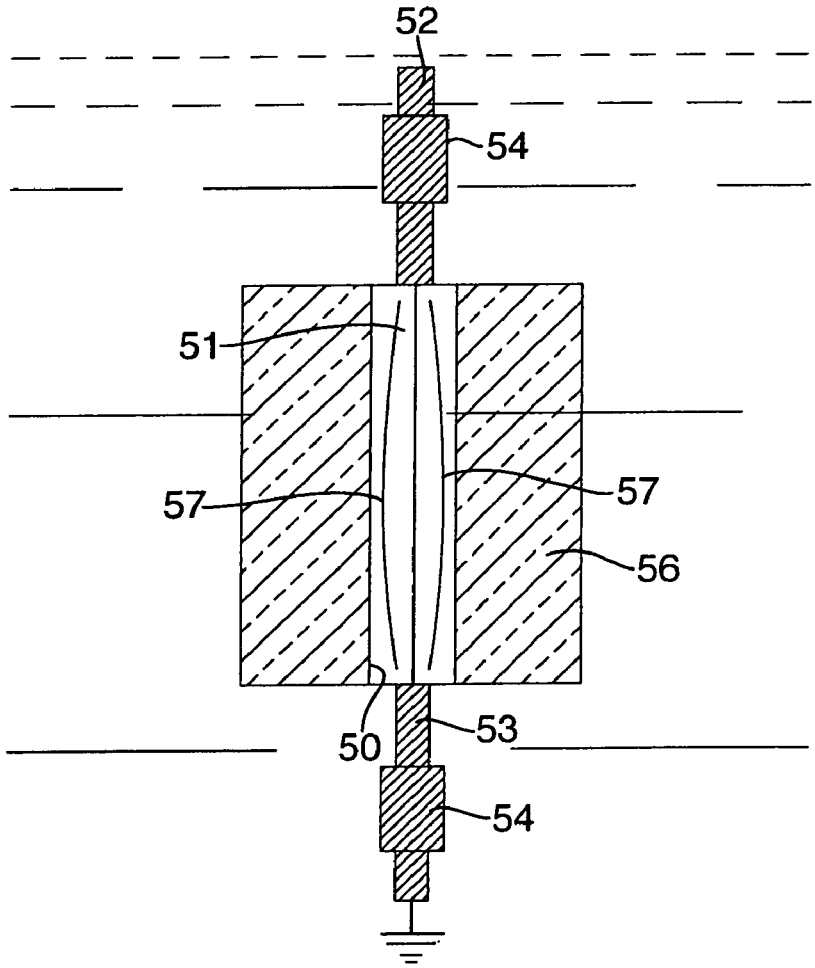

Referring to FIG. 5 in an alternative embodiment of the invention, the conducting wire is placed within a cavity or a hole inside the workpiece. This location of the wire allows internal surfaces of the workpiece to be peened with the HPU pulses.

FIG. 5 provides a schematic illustration of a third embodiment of a peening arrangement in accordance with present invention. Thus, a thin electrical wire 51 extends from a high voltage electrode 52 to a ground electrode 53. The electrodes 52, 53 are protected by insulators 54 and the whole arrangement submerged in a dielectric liquid. In such circumstances when an electrical pulse is passed along the wire 51 there is vaporisation and as a result of breakdown of the vaporisation products, a high power ultrasound pulse 57 emanates from the wire 51 towards a component or workpiece 56.

In the embodiment depicted in FIG. 5 internal cavity or passage peening treatment is performed upon the component 56. Thus, as illustrated, the wire 51 extends through a passage or cavity 50 in the component 56. In such circumstances, the pressure pulse or HPU wave impinges upon the internal cavity 50 surfaces in order to provide peening treatment as described previously.

From the above it will be appreciated that achieving compressive residual stresses to a greater depth into a component will have particular advantages with regard to resisting crack and other potential sources of failure in a component such as an aerofoil for a gas turbine engine. Use of electrical wire vaporisation in order to act as an initiator for acoustic pressure waves in a dielectric liquid which impinges upon a surface in order to create impact compression is advantageous. The electrical wire will always provide a preferred electrical discharge route such that dangers with respect to electrical discharge damage direct to the component are diminished. Whilst as indicated a significantly greater area of the component can be treated in each shock pulse discharge in comparison with laser peening techniques as described above. The traditional mechanical ball peening approach provides only limited treatment and, as indicated, can roughen the surface presenting itself potential sites for fatigue failure through cracking and also potentially having a detrimental effect with regard to air flow in aerofoil components.

The present invention addresses a problem of improving fatigue life time for metal workpieces by introducing deep residual compressive stresses in their surface layers. The invention presents a method of introduction of high residual compressive stresses in a metal workpiece including the generation of a shock wave by means of explosive electrical evaporation of a thin conducting wire within a liquid medium located adjacent the metal workpiece. Fast evaporation of the wire and the consequent electrical breakdown of the channel or cavity filled with metal/liquid vapour results in emission of a high power ultrasound (HPU) pulse which impacts upon the surface of the workpiece introducing deep residual compressive stress within a surface layer of the workpiece to be processed.

As indicated above, the present invention utilises an electrical wire which is subjected to electrical discharge sufficient to cause vaporisation of the wire. The electrical discharge is pulsed in order to create the necessary cascade of shock waves for impingement upon the component in order to create the surface residual stressing required. It may be that the initial position of vaporisation upon the lengths of wire varies such that the epicentre for each shock wave alters along the length of the wire and therefore the shockwave impingement angle on the component itself slightly varies. It will also be understood that the position of the wire relative to the component can adjust this impingement angle for the shock wave generated by vaporisation/electrical breakdown and there may be attenuation/cushioning effects due to the dielectric liquid between the source of the shock wave and impact upon the component. These factors can be adjusted in order to provide randomisation with respect to the impacts and therefore avoid potential structural directionality with respect to the surface residual stressing incorporated into the component.

As indicated above, randomisation with respect to impact upon the component may be advantageous. Thus, as indicated, a wire feeder can be utilised. This wire feeder may comprise opposed electrodes with the wire being pushed from the feeder electrode towards a contact electrode such that upon contact an electrical pulse discharge is achieved creating vaporisation and therefore the shock wave desired. Typically, the distance between the electrodes will be in the order of 15 mm and if this distance is fixed there may be some predictability with respect to the epicentre of the shock wave in terms of vaporisation initiation of the electrical wire. Alternatively, by varying the distance between the electrodes and therefore the length of wire it may be possible to adjust the position of a shock wave epicentre initiation and therefore the impingement angles upon the component for peening to create residual stresses in the surface layer.

The wire feeder, as also indicated above, may take the form of a carousel in which a number of banks of wire are arranged to consecutively receive an electrical pulse to cause vaporisation and therefore shock wave propagation towards a component. Again the length of these wires, thickness of the wires and potentially the material from which the wires are made may be varied in order to adjust and control the shock wave in terms of magnitude as well as impingement angle of the shock wave upon the component to achieve desired peening effects.

As indicated above, generally reflectors will be used in order to regulate the shock waves sent to the component. The reflectors as indicated can be shaped appropriately to achieve shock wave propagation effects. Thus, the reflectors may be cylindrical or otherwise shaped in order to create focused shock wave reflection towards the component. Nevertheless it will be appreciated that reflected shock waves will propagate through the dielectric liquid and therefore will generally be attenuated and damped by that reflective transmission path. Typically, the wire as illustrated in the Figs. will be located between the reflector and the component such that the relative spacing, positioning and configuration of the reflector, wire and component surface to be treated can be adjusted to achieve the desired peening effect. The reflector may be static or dynamically moved in the peening arrangement of the present invention in order to provide consistent reflectivity or some randomisation with regard to shock wave reflectivity.

As indicated the proximity of the electrical wire to the component in respect of the propagation distance for the shock wave towards the component is important in terms of efficiency of the peening process through surface compression. Generally, the closer the wire to the surface the greater the peening effect as there is less attenuation damping of the acoustic wave through the dielectric liquid. Unfortunately, close proximity of the vaporising electrical wire can cause surface degradation by the products of the vaporisation. In such circumstances as indicated above, a protective surface can be provided to the component.

It will be understood that the particular materials from which the electrical wire is made, the electrical pulse charging values and distances will all be varied dependent upon required peening performance. Thus, a person skilled in the art will understand and appreciate variations possible within the scope of the present invention.

The invention provides an apparatus and a method for non contact treatment of a workpiece surface with high power ultrasound pulses using wire guided high voltage spark discharges in dielectric liquids.

The apparatus to process a metal workpiece with HPU pulses comprises a high voltage pulsed power system for a wire guided acoustic source for emitting high power ultrasound pulses, and a workpiece holder. The acoustic source of the apparatus normally comprises a thin conductive wire holder and feeder and may include a reflector or a restraining member to increase effectiveness of the treatment.

Impulse Joule heating of a thin conductive electrical wire generates a fast expanding plasma channel in a dielectric liquid medium (water or mineral oil). The thin conducting wire is preferably placed between a high voltage and a ground electrode of the wire guided electrical shock peening apparatus. The presence of the wire prevents the development of electrical discharges to the metal workpiece and therefore allows the distance between the HPU source and the surface of the metal workpiece to be reduced thereby maximising the HPU pressure at the surface to be treated.

Preferably the pulsed power system is capable of delivering of peak powers in the plasma discharges (channel) of between 10 and 100 MW. Preferably the high voltage pulse has an energy in the range 100-2000 J. The applied voltage is at least 10 kV and preferably in the range 20-50 kV. The preferable rise time of the voltage is at least 10 MV/microsecond.

The means of providing a fast expanding plasma channel may include a high voltage and a ground electrode and a thin conducting wire between them. The wire will be conducting and may be formed from aluminium, carbon fibre, copper or silver wire and preferably has a diameter in the range 100-500 micrometers.

The method may include the step of adjusting the length of the conducting wire to the parameters of the pulsed power circuit. This will allow the efficiency of conversion of the electrical energy to the HPU acoustic energy to be increased and the treatment area to be maximised and should result in an increase in the effectiveness of the wire guided electrical spark peening process.

Preferably the distance between the wire and the metal workpiece is in the range 1-10 mm. Preferably the length of the conducting wire is at least 15 mm. The wire may be located above the metal workpiece. Also the wire may be located between the metal workpieces inside holes or cavities to the workpiece. This will provide shock peening treatment to internal regions of the workpiece or component.

The method may include the step of providing an automatic change of wires after each evaporation by means of a wire feeder. The wire holder may be a carousel providing evaporation of a single wire during each current pulse. The HPU acoustic source may have a reflector to concentrate energy on the surface of the metal part.

Wire guided electrical shock peening results in the generation of residual compressive stresses to a depth comparable with laser shock peening and several times greater than that achieved with shot-peening. Wire guided electrical shock peening treatment significantly reduces surface deformation. These factors should produce a superior fatigue performance for materials treated with wire guided electrical shock peening compared with material treated with mechanical peening, and with a process which is lower cost and very much faster than shot or laser peening. Wire guided electrical shock peening processes have the benefit of being able to treat a significantly larger area per pulse than laser shock pulsing, thus allowing more rapid area coverage and the potential for application of treatment to critical components of irregular geometries. A further potential technological advantage of the wire guided electrical shock peening method is the use of a relatively inexpensive pulsed delivery system. In spite of the extremely high peak powers being delivered in plasma discharges, the pulsed power system requires only a few kW of input power.

Key advantages of the present invention as compared with a plasma discharge peening method are as follows:—

Energy available in the wire guided plasma discharge is several times greater than that in free discharge described. This should result in much higher pressures developed in the HPU pulse and consequently to significantly deeper and higher compressive residual stresses in the workpiece.

The length of the wire guided plasma discharge is several times greater than that in free discharge. This should result in an ability to treat a significantly larger area per pulse.

It will be appreciated that the electrical pulsing provided to the electrical wire is important in order to achieve appropriate evaporation. It is the evaporation products and in particular the plasma breakdown which creates the shockwave for peening effect. In such circumstances different types of electrical pulse presentation and generating systems can be used. Amongst these arrangements are Marx type generators, RLC generators, pulse forming lines and Blumlein generators.

It will be understood that high pressure ultrasonic pulses generated in accordance with the present invention with high voltage spark discharges can be used in many appropriate areas. These include intensifying chemical processes, metal forming and deformation, breaking of brittle solid materials (lithotripsy, mineral engineering, environmental protection), breakage of biological cell membranes etc. Thus in addition to peening of components, it will be understood that shock waves in dielectric liquids can be utilised in these areas as well.

The invention claimed is:

1. A peening arrangement for a component, the arrangement comprising an electrical conductor, a volume of dielectric liquid and means to provide an electrical pulse to cause vaporisation of the electrical conductor, the arrangement being provided with means for presentation of a component in use in the volume of dielectric liquid adjacent to the electrical conductor, but without a die adjacent to the component, to receive shock waves caused by vaporisation of the electrical conductor due to the electrical pulse.

2. An arrangement as claimed in claim 1 wherein a reflector is positioned to reflect shock waves towards a component in use.

3. An arrangement as claimed in claim 1 wherein an electrical conductor feeder is provided in the arrangement.

4. An arrangement as claimed in claim 3 wherein the feeder comprises a feeder electrode to push the electrical conductor towards a contact electrode to provide a pulse when contact is made between the electrical conductor and the contact electrode.

5. An arrangement as claimed in claim 3 wherein the feeder comprises a carousel that includes a plurality of single electrical conductors extending between electrodes with the carousel adjusting after each evaporation of the electrical conductor to present a new electrical conductor adjacent a component in use.

6. An arrangement as claimed in claim 1 wherein the arrangement incorporates a number of electrical conductors to provide respective shock waves.

7. An arrangement as claimed in claim 1 wherein an electrical conductor is provided to one side of a component in use.

8. An arrangement as claimed in claim 1 wherein an electrical conductor substantially surrounds a component in use.

9. An arrangement as claimed in claim 1 wherein an electrical conductor enters a cavity or hole in the component in use.

10. An arrangement as claimed in claim 1 wherein the means to provide the electrical pulse is adjustable to vary the strength of the shock wave.

11. An arrangement as claimed in claim 1 wherein the arrangement incorporates means to equalise the shock wave along a length of the electrical conductor upon presentation to a component in use.

12. An arrangement as claimed in claim 1 wherein the arrangement incorporates means to provide a protective coating to a component to protect the component from vaporisation products produced by an electrical discharge.

13. An arrangement as claimed in claim 12 wherein the protective coating is removable.

14. An arrangement as claimed in claim 1 wherein the electrical conductor is a wire.

15. An arrangement as claimed in claim 1 wherein the arrangement includes means for adjusting a length of the electrical conductor.

16. A method of peening a component, the method comprising presenting a component and an electrical conductor adjacent to one another within a volume of dielectric liquid, but without a die adjacent to the component, presenting an electrical pulse in the electrical conductor sufficient to cause evaporation of the electrical conductor and subsequent electrical breakdown of a resultant vapour to provide a pressure pulse to impact as a shock wave upon the component.

17. A method as claimed in claim 16 wherein the method includes providing a protective coating to the component.

18. A method as claimed in claim 16 wherein the method includes adjusting a length of the electrical conductor to vary the vaporisation of the electrical conductor to adjust the pressure pulse for impact upon the component.

19. A method of peening a component using a peening arrangement as claimed in claim 1.

20. A component subject to a method of peening as claimed in claim 16.

21. A component as claimed in claim 20 wherein the component is an aerofoil of a gas turbine engine.

22. A method of peening a component, the method comprising presenting a component and an electrical conductor adjacent to one another within a volume of dielectric liquid, presenting an electrical pulse in the electrical conductor sufficient to cause evaporation of the electrical conductor and subsequent electrical breakdown of a resultant vapour to provide a pressure pulse to impact as a shock wave upon the component, wherein the electrical pulse has a duration of 1 to 300 microseconds, a rise time of a voltage of the electrical pulse is at least 10 MV/microsecond and the electrical pulse has an energy of 100 to 2000 J.

23. A method as claimed in claim 16 wherein the electrical pulse has a duration of 1 to 300 microseconds.

24. A method as claimed in claim 16 wherein a rise time of a voltage of the electrical pulse is at least 10 MV/microsecond.

25. A method as claimed in claim 16 wherein the electrical pulse has an energy of 100 to 2000 J.

* * * * *